US005407560A

United States Patent [19]

Miyawaki et al.

[11] Patent Number: 5,407,560

[45] Date of Patent: Apr. 18, 1995

[54] PROCESS FOR MANUFACTURING PETROLEUM COKES AND CRACKED OIL FROM HEAVY PETROLEUM OIL

[75] Inventors: Shintaro Miyawaki, Tokyo; Kiyomi Ishii, Saitama; Mamoru Yamane, Tokyo, all of Japan

[73] Assignee: Japan Energy Corporation, Tokyo, Japan

[21] Appl. No.: 851,956

[22] Filed: Mar. 16, 1992

[51] Int. Cl.[6] ..... C10G 9/00

[52] U.S. Cl. ..... 208/106; 208/131; 208/132; 208/22; 44/641; 44/591; 44/603; 44/607

[58] Field of Search ..... 208/106, 131, 132, 22; 44/641, 591, 603, 607

[56] References Cited

U.S. PATENT DOCUMENTS 1,576,179 3/1926 Derby et al. ..... 44/603
2,014,686 9/1935 Lubovitch et al. ..... 44/603
4,913,801 4/1990 Forester ..... 208/121
4,962,264 10/1990 Forester ..... 585/648
4,968,322 11/1990 Miyawaki et al. ..... 44/364
5,064,524 11/1991 Forester ..... 208/121

FOREIGN PATENT DOCUMENTS 03095292 4/1991 Japan .

OTHER PUBLICATIONS

I & EC Produce Research & Development, vol. 25, No. 2, pp. 198–201 (1986).
ACS Symposium Series, 260, pp. 263–277 (1984).

*Primary Examiner*—Asok Pal
*Assistant Examiner*—Walter D. Griffin
*Attorney, Agent, or Firm*—Birch, Stewart, Kolasch & Birch

[57] ABSTRACT

A novel process is disclosed by which petroleum cokes and cracked oil can be produced by thermal cracking of a heavy petroleum oil to which a rare earth metal compound is added. The process produces petroleum cokes with an improved combustibility and promotes the yield of cracked oil at the same time.

19 Claims, 2 Drawing Sheets

PROCESS FOR MANUFACTURING PETROLEUM COKES AND CRACKED OIL FROM HEAVY PETROLEUM OIL

FIELD OF THE INVENTION

The present invention relates to a process for efficiently manufacturing petroleum cokes with excellent properties as a fuel and cracked oil in improved yields at the same time by thermal cracking of heavy petroleum oils.

BACKGROUND OF THE INVENTION

Petroleum cokes are products obtained by thermal cracking of heavy petroleum oils. Delayed coking, fluid coking, contact coking, and flexi coking are known in the art as processes for manufacturing petroleum cokes. Among the petroleum cokes manufactured by these processes, there are green cokes containing about 10% of volatile matters and calcined cokes which are obtained by calcining the green cokes at a high temperature to remove the volatile matters and to effect crystallization. Green cokes are mainly used as fuels. Among calcined cokes, those containing only a small amount of impurities and possessing high crystallinity are used as raw materials for manufacturing electrodes and carbonaceous materials.

Petroleum cokes have a higher heating value and contain less ashes than coal, but their ignitability is worse than coal. Since petroleum cokes are inexpensive, they are used as fuels for boilers, calcination of cement, and the like. Petroleum cokes with better ignitability when burning are thus desired. Petroleum cokes are dried and then pulverized prior to use into particles or powders with diameters of 200 mesh or smaller. Since the pulverization consumes a significant energy, petroleum cokes which can be easily pulverized are desired.

In addition, development of a technology to increase the yield of cracked oil in the thermal cracking of heavy petroleum oils has been desired.

DESCRIPTION OF RELATED ART

U.S. Pat. No. 4,962,264 discloses effects of rare earth metal compounds for preventing coke-like matters from accumulating on the surface of cracking tubes used in the thermal cracking of butane or naphtha for the manufacture of ethylene. The patent claims that addition of rare earth metal compounds to petroleum oil feedstocks or directly to cracking tubes eliminates the problem of deceased thermal conductivity due to the accumulation of coke-like matters.

U.S. Pat. Nos. 4,913,801 and 5,064,524 disclose addition of rare earth metal compounds to feedstocks or catalyst regeneration columns in the fluid cracking process for suppressing a decrease in the yield of gasoline fraction due to accumulation of nickel or vanadium on the surface of the catalyst.

Rare earth metal compounds are also known to be effective as a combustion improver of fuels. For example, U.S. Pat. No. 4,968,322 discloses a combustion promoter of heavy petroleum oils comprising two or more fatty acid soaps of cerium, neodymium, or lanthanum.

However, there has been no technology in the art concerning a thermal cracking process of heavy petroleum oils for manufacturing petroleum cokes with high combustibility and, at the same time, producing cracked oil in a high yield.

SUMMARY OF THE INVENTION

The present inventors have made intensive investigations into developing a technology with a view to solving the aforementioned problems. As a result, the present inventors found that when one or more rare earth metal compounds in an amount of effective ratio is added in advance to heavy petroleum oil as a raw material, thermal cracking of such a heavy petroleum oil at a temperature of 450°–650° C. not only produces petroleum cokes with excellent combustibility, but also increases the yield of cracked oil. Such a finding has led to the completion of the present invention.

Accordingly, the present invention is directed to a process for manufacturing petroleum cokes for fuel with excellent combustibility and also cracked oil in a high yield comprising adding one or more rare earth metal compounds in an amount of effective ratio to heavy petroleum oil and subjecting the heavy petroleum oil to thermal cracking.

The process of the present invention thus provides petroleum cokes which are readily ignited and easily pulverized. The present invention also inhibits high temperature corrosion due to vanadium, and at the same time, increases the yield of cracked oil. Furthermore, according to the present invention, heavy petroleum oils containing metals such as vanadium can be used as a raw material for thermal cracking, thus ensuring a wide spectrum of selection of raw material oils for the thermal cracking.

DETAILED DESCRIPTION OF THE INVENTION

Raw Material Oils

Figure 1:
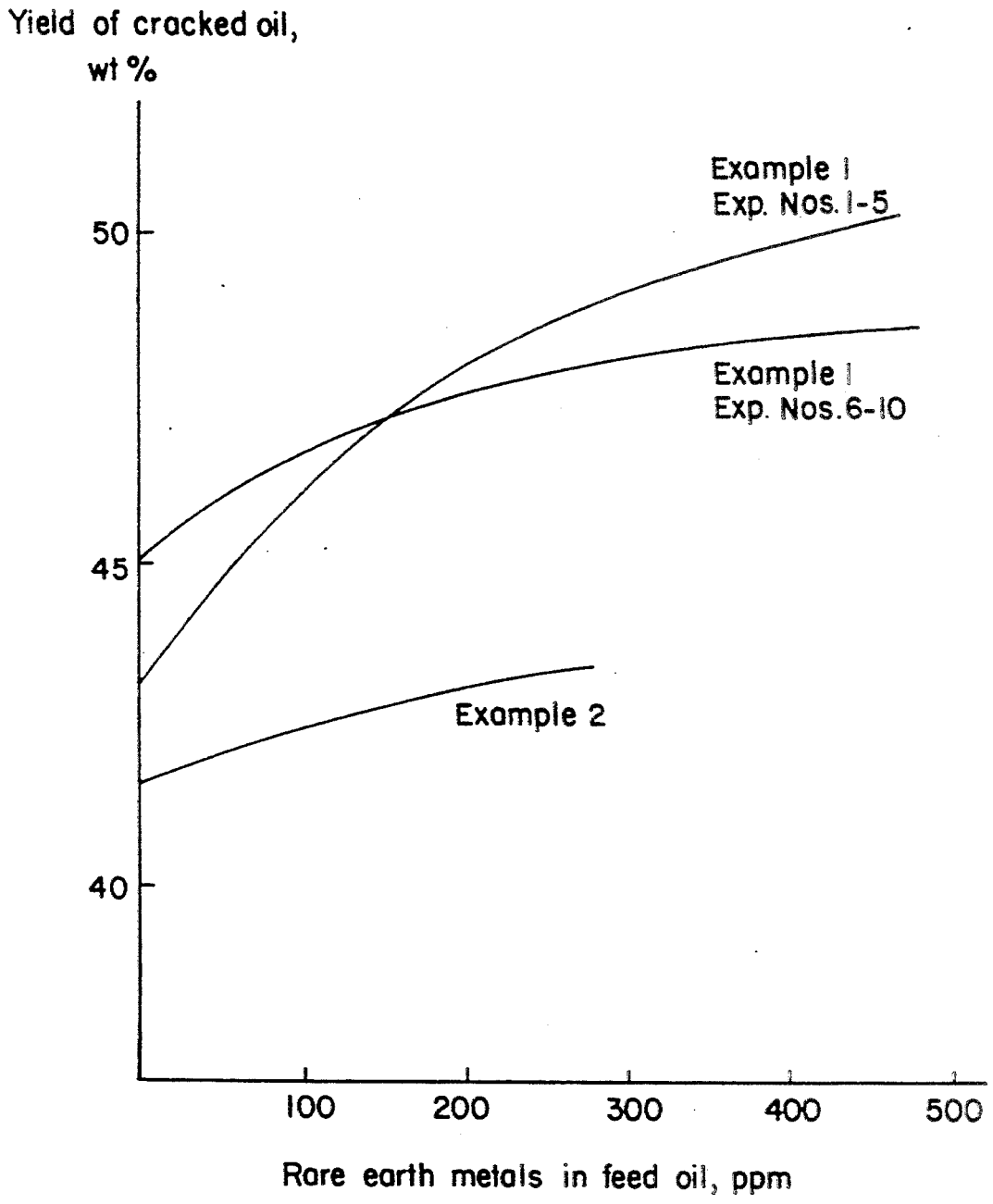
FIG. 1 is a graph showing the relationship between concentration of rare earth metal in feed oil and yield of cracked oil.
Figure 2:
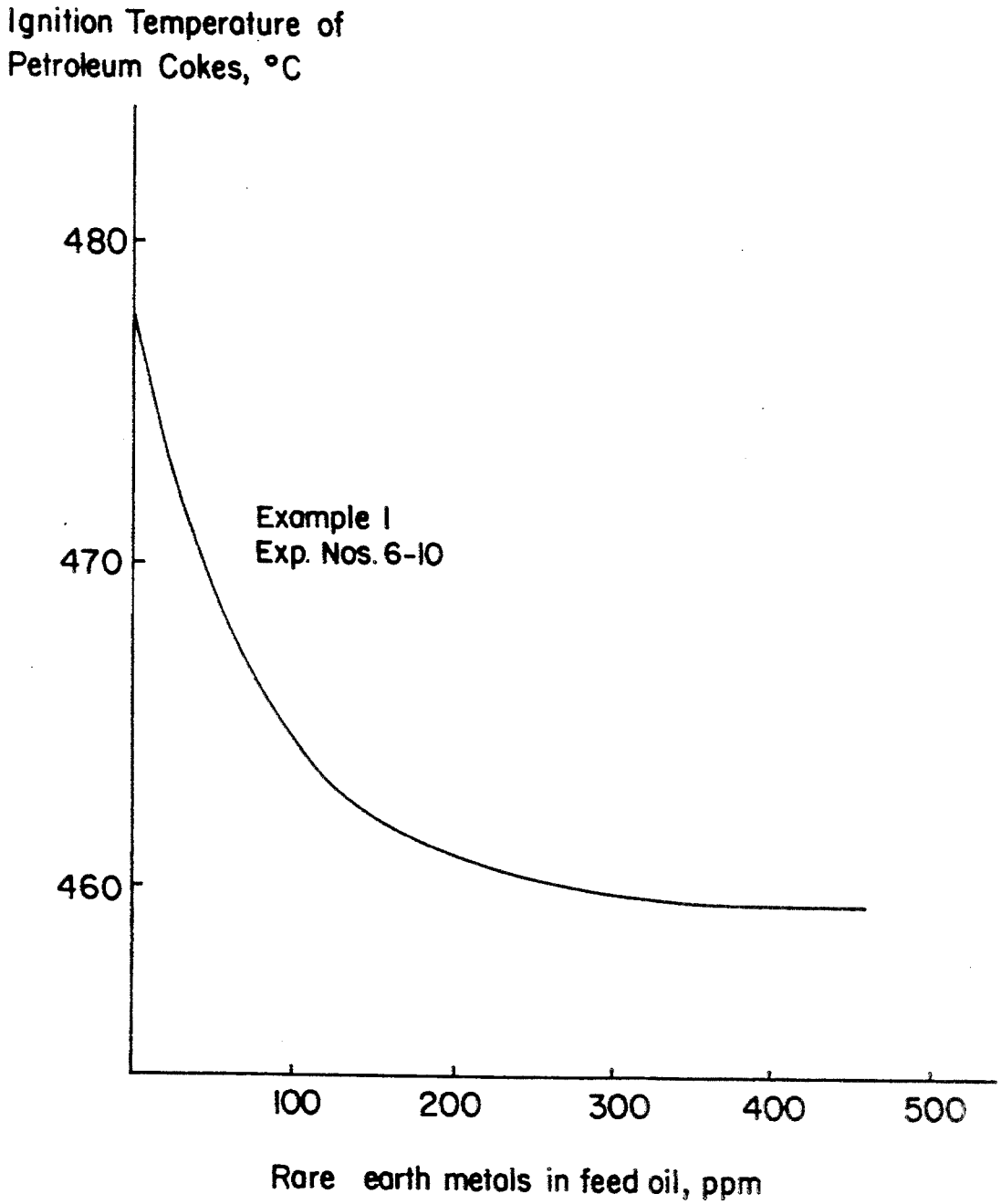
FIG. 2 is a graph showing the relationship between concentration of rare earth metal in feed oil and ignition temperature of petroleum cokes.

Any conventionally known heavy petroleum oils can be used as a raw material oil for the process of the present invention, including residual oils from atmospheric or vacuum distillation of petroleum crude oils, tar oils or cycle oils from thermal cracking or catalytic cracking processes of petroleum heavy oils, tar sand oil, liquefied coal oils, and the like. They can be used individually or two or more of them may be used together. These heavy petroleum oils usually contain about 5–25% by weight of asphalten, about 10–30% by weight of residual carbon, and about 20–2,000 ppm of vanadium. Since the process of the present invention can be applied to any heavy petroleum oils irrespective of these contents, the process ensures a wide spectrum of selection of raw material oils.

Rare Earth Metal Compounds

In the process of the present invention, a rare earth metal compound is added to raw material heavy petroleum oils before the thermal cracking. Here, mentioned as examples of rare earth metals are cerium (Ce), lanthanum (La), neodymium (Nd), praseodymium (Pr), samarium (Sm), promethium (Pm), europium (Eu), gadolinium (Gd), and the like. They may be used individually or two or more of them can be used in combination. Organic or inorganic compounds which contain these metals can be used as an additive for heavy petroleum oils as a raw material.

As organic compounds of rare earth metals, salts of fatty acid such as salts of saturated or unsaturated fatty acid having 3–18 carbon atoms, e.g., butylic acid, heptanic acid, caprylic acid, capric acid, neodecanoic acid, 2-methylhexanoic acid, pelargonic acid, lauric acid, stearic acid, etc.; salts of dicarboxylic acids, e.g., oxalic acid, succinic acid, etc.; salts of aromatic carboxylic acid, e.g., benzoic acid, salicylic acid, etc.; naphthenates, sulfonates, chelating compounds, e.g., acetyl acetonate, alkoxide, e.g., methoxide, ethoxide, butoxide, etc., and the like can be used either singly or in combination of two or more. An organic compound mixture of fatty acid soap of rare earth metals which contains 30–60% of cerium, 20–30% of lanthanum, and 10–30% of neodymium is preferable from the aspect of its performance and economy. Rare earth metal compounds which are soluble in heavy petroleum oils are preferable. They may be added to heavy petroleum oils either directly or dissolved in an organic hydrocarbon oil, such as aromatic hydrocarbon, kerosene fraction, ester, polyoxyalkylene glycol, or the like with a comparatively high boiling point such as such as 250° C. or higher.

Given as other rare earth metal compounds are inorganic compounds such as carbonates, e.g., $Ce_2(CO_3)_3$, $La_2(CO_3)_3$, $Pr_2(CO_3)_3$, $Sm_2(CO_3)_3$, $2Na_2CO_3.Ce_2(CO_3)_3$, $K_2CO_3.La_2(CO_3)_3$, $3Na_2CO_3.2Nd(CO_3)_3$, oxycarbonates, etc., e.g., $Ce_2O(CO_3)_2$, $La_2O(CO_3)_2$, $Nd_2O(CO_3)_2$, etc., hydroxides, or their hydrates. For the addition of these inorganic compounds to raw material heavy petroleum oils, powders of these inorganic compounds with a particle size of 100 μm or smaller, preferably 50 μm or smaller, are preferably made into a homogeneous dispersion by dispersing into a portion of raw material heavy petroleum oils of which the fluidity is increased by heating or the like. Halogen compounds and nitrates are undesirable because of corrosion in the thermal cracking equipment due to corrosive gases generated when they are decomposed.

Amounts of Rare Earth Metal Compounds to be Added

In the process of the present invention, an amount of rare earth metal compounds to be added to heavy petroleum oils is determined depending on characteristics of the heavy petroleum oils, conditions of thermal cracking, intended properties of petroleum cokes, and the like. As is known in the art, the yield of petroleum cokes varies within the range of 15–50% by weight or more of raw material heavy petroleum oil depending on the thermal cracking conditions and types of the heavy petroleum oils, and all rare earth metals of added organic or inorganic compounds in the heavy petroleum oil are decomposed thermally, and the resulting rare earth metal and/or their oxides are transferred to and accumulated in petroleum cokes. This means that the amounts of rare earth metals which are added to the heavy petroleum oil as their compounds are concentrated in petroleum cokes to a concentration of about 2–6 times of that in the heavy petroleum oil.

Unless otherwise specified, amounts of rare earth metal compounds added to heavy petroleum oil or amounts of rare earth metals in petroleum cokes in the present invention are expressed by parts by weight as rare earth metal elements.

In order to manufacture petroleum cokes with excellent combustibility intended by the present invention, it is desirable that petroleum cokes should contain an effective amount of at least one rare earth metal, such as 20 ppm or more, preferably 30 ppm or more, and more preferably 50 ppm or more, as element of rare earth metals. With the increase in the rare earth metal content to about 5,000 ppm in the petroleum cokes, combustibility of the cokes is improved gradually. A great improvement in the combustibility is recognized in the range of 20–1,000 ppm, particularly 30–1,000 ppm, of rare earth metal as element in the cokes. Accordingly, from the aspect of improvement of combustibility of the cokes, an economical rare earth metal content in petroleum cokes is 20–5,000 ppm, preferably 30–5,000 ppm, and more preferably 50–1,000 ppm (as element).

On the other hand, for the purpose of promoting the yield of cracked oil by the thermal cracking, an effective amount of at least one rare earth metal compound is added to the raw material heavy petroleum oil, suitably in an amount of 5–3,000 ppm, preferably 10–2,000 ppm, more preferably 20–2,000 ppm (as element). The yield of cracked oil is promoted as the amount of rare earth metal added increases. A particularly large increase in the yield of cracked oil results in the range of 20–300 ppm (as element).

In summary, it is desirable to determine the amount of rare earth metals to be added to heavy petroleum oil as a raw material in the range of 5–3,000 ppm, preferably 10–2,000 ppm, and more preferably 20–2,000 ppm (as element); and their content in resulting petroleum cokes is desirably 20–5,000 ppm, and preferably 30–5,000 ppm (as element).

Conditions of Thermal Cracking

In the present invention, heavy petroleum oil to which rare earth metals are added is thermally cracked by the conventionally known delayed coking process, fluid coking process, contact coking process, or flexi coking process. "Thermal cracking" as used in the present invention can alternatively be called "coking" which means a treatment, such as cracking and polymerizing, for the manufacture of cokes.

Thermal cracking conditions are determined depending on the hydrocarbon composition of heavy petroleum oil which is a raw material, the yield and properties of petroleum cokes to be manufactured, the yield of the cracked oil, and the like. Generally preferable cracking temperatures and pressures are 450°–650° C. and atmospheric pressure to 15 kg/cm$^2$·G. When heavy petroleum oil is thermally cracked, cracked oil is produced together with gaseous products such as hydrogen, methane, ethane, ethylene, propane, propylene, butane, butylene, and the like. Cracked oil is a fraction with a boiling point range of about 30°–560° C., of which the major components are olefins and aromatic hydrocarbons. The cracked oil can be fractionated into light naphtha, heavy naphtha, kerosene, gas oil, and heavy oil for use as fuels or raw materials of petrochemical products. A high boiling fraction in the cracked oil may be recycled for further thermal cracking.

Effects of the Invention

Petroleum cokes manufactured by the process of the present invention contain 20–5,000 ppm (as element). When the petroleum cokes are used as a fuel, their particle size is suitably adjusted by pulverization or the like depending on the desired use. The petroleum cokes manufactured by the process of the present invention have advantages as fuels over cokes obtained by conventional thermal cracking processes in which no rare earth metals are added, because they possess more excellent combustibility and are pulverized more easily than cokes manufactured by conventional processes.

Furthermore, according to the process of the present invention, the yield of cracked oils is increased by 0.5–8% as compared with conventional thermal cracking processes using no rare earth metal compounds as an additive. This is a great advantage of the present invention. Rare earth metals or their compounds converted by thermal cracking of added rare earth metal compounds are transferred into petroleum cokes and uniformly present therein. The combustibility of the cokes of the present invention is superior to conventional cokes which were manufactured without the use of rare earth metal compounds in the thermal cracking.

Other features of the invention will become apparent in the course of the following description of the exemplary embodiments which are given for illustration of the invention and are not intended to be limiting thereof.

EXAMPLES

EXAMPLE 1

Heavy petroleum oils as a raw material were thermally cracked into petroleum cokes and cracked oils in a thermal cracking apparatus comprising a stainless steel tube reactor connected with a cracked oil collector, a gas collector, piping for pressurizing gas, and a pressure indicator. The tube reactor was designed with a length of 150 mm and an internal diameter of 21 mm. The compound, 2-ethylhexanoate of rare earth metal (RE1) shown in Table 2, was added to feed oil No. 1 shown in Table 1, which was pre-heated to 200° C., the amount of rare earth metal as element being 40 to 400 ppm as shown in Table 3, and then the mixture was stirred thoroughly. 20 gm of the mixture was charged into a heat-resistant glass vessel and the vessel was placed in the tube reactor. After allowing it to stand under a reduced pressure of about 10 mm Hg and at a temperature of 200° C. for 3 hours to remove light fractions, the tube reactor was filled and pressurized with nitrogen gas up to 1.4 or 4.2 kg/cm$^2$·G. The tube reactor was heated at a rate of 250° C. per minute up to a cracking temperature of 465° C., at which temperature the thermal cracking was carried out for 8 or 12 hours, while collecting gases and cracked oil generated during the thermal cracking. The glass vessel was cooled, dismantled from the tube reactor, and weighed to calculate the yield of petroleum cokes from the weights before and after the reaction. The glass vessel was broken to take out petroleum cokes. The thermal cracking conditions and the results are shown in Table 3.

TABLE 1

| | Feed Oils*1 | | |
|---|---|---|---|
| | No. 1 | No. 2 | No. 3 |
| Specific gravity | 1.047 | 1.0556 | 0.9987 |
| Sulfur (wt. %) | 5.26 | 4.56 | 1.54 |
| Residual carbon (wt. %) | 25.1 | 27.1 | 17.4 |
| Asphaltene (wt. %) | 13.6 | 18.3 | 4.7 |
| Ash (wt. %) | 0.04 | | 0.03 |
| Metals (ppm): | | | |

TABLE 1-continued

| | Feed Oils*1 | | |
|---|---|---|---|
| | No. 1 | No. 2 | No. 3 |
| V | 180 | 490 | 28 |
| Ni | 53 | 104 | 62 |
| Fe | 25 | 46 | 17 |

*1Feed Oil No. 1: Vacuum distillation residue of Middle East crude oil.
Feed Oil No. 2: Vacuum distillation residue of Mexican crude oil.
Feed Oil No. 3: Vacuum distillation residue of Chinese crude oil.

TABLE 2

| | Rare Earth Metal Compounds | |
|---|---|---|
| Percentage of metal element (wt. %) | RE1*1 | RE2*2 |
| Ce | 50.2 | 100 |
| La | 25.9 | — |
| Nd | 18.1 | — |
| Pr | 5.3 | — |
| Sm | 0.5 | — |

*1RE1: 2-Ethylhexanoate
*2RE2: A fine powder of $Ce_2(CO_3)_3.2H_2O$ (average particle size: 43 μm)

Petroleum cokes prepared in Experiment Nos. 6–10 listed in Table 3 were pulverized to 12–16 mesh, washed with chloroform to remove the attached oil, further washed with acetone, and dried at 150° C. The ignition temperature of each product was measured by the following method.

Measurement of Ignition Temperature (Ti)

A carbon air reactivity measurement device (model RDC141: trademark, manufactured by Swiss R&D Carbon Co.) was used for the measurement. 5.0 gm of petroleum coke powder was placed in a quartz tube. The tube was inserted into a heater which was preheated to 300° C. in advance. The temperature was raised at a rate of 10° C. per minute to accurately detect a rapid increase in the temperature by ignition. The temperature thus detected was taken as the ignition temperature (Ti).

TABLE 3

| Experiment*1 No. | Amount of RE1*2 added (ppm) | Petroleum coke Yield (wt. %) | Petroleum coke RE (ppm)*3 | Cracked oil Yield (wt. %) | Ti (°C.) |
|---|---|---|---|---|---|
| 1 | Not added | 36.5 | 0 | 43.2 | |
| 2 | 40 | 35.1 | 114 | 44.3 | |
| 3 | 120 | 32.7 | 367 | 46.7 | |
| 4 | 200 | 31.1 | 643 | 48.7 | |
| 5 | 400 | 30.0 | 1,333 | 49.8 | |
| 6 | Not added | 34.8 | 0 | 45.0 | 479 |
| 7 | 40 | 34.0 | 118 | 45.8 | 472 |
| 8 | 120 | 32.5 | 369 | 47.2 | 461 |
| 9 | 200 | 32.1 | 623 | 47.6 | 461 |
| 10 | 400 | 30.7 | 1,303 | 48.4 | 460 |

*1Cracking conditions:
Experiment Nos. 1–5: temperature 465° C.; pressure, 4.3 kg/cm$^2$ · G; 12 hours
Experiment Nos. 6–10: temperature, 465° C.; pressure, 1.4 kg/cm$^2$ · G; 8 hours
*2The amount of RE1 added: Amount of elements.
*3Calculated based on the amount of RE1 added and the petroleum coke yield.

As demonstrated by the results shown in Table 3, thermal cracking of heavy petroleum oils in which rare earth metal compounds were included greatly increased the yield of cracked oil and produces petroleum cokes with excellent combustibility.

EXAMPLE 2

Feed oil No. 2 shown in Table 1, which was preheated to 200° C., was added with rare earth metal compound RE2, cerium carbonates (200 ppm, as element) of Table 2. The mixture was thermal cracked in the same apparatus as used in Example 1 under the conditions of 463° C. and 1.4 kg/cm$^2$·G for 8 hours. The results are shown in Table 4.

TABLE 4

| Amount of RE2 added (ppm) | Petroleum coke Yield (wt. %) | Cracked oil Yield (wt. %) |
|---|---|---|
| Not added | 37.8 | 41.7 |
| 200 | 36.3 | 42.9 |

Table 4 demonstrates that the thermal cracking of the feed oil with the addition of cerium carbonate increases the yield of cracked oil.

EXAMPLE 3

A thermal cracking reaction was carried out on 60 gm of feed oil No. 2 of Table 1 by adding rare earth metal compound RE1 of Table 2 in an amount of 200 ppm (as element) by using a large scale stainless steel pressure-resistant tube reactor (length: 297 mm, internal diameter: 85 mm) under the conditions of 463° C. and 1.4 kg/cm$^2$·G for 8 hours. The petroleum coke obtained was washed and dried in the same manner as in Example 1. Contents of vanadium and rare earth metals in the cokes, and pulverizability (HGI) of the cokes were measured. The results are shown in Table 5.

Measurement of Hard Grove Index (HGI)

HGI was measured according to the method JIS M8801; Standard Test Method for Grindability of Coal by the Hardgrove Machine Method. The petroleum coke was pulverized into 14–28 mesh, placed in a bearing steel globe, and pulverized under a load of 3.9 kg while rotating the globe 60 times. The petroleum coke powder thus obtained was screened through a 200 mesh sieve to weigh the residual amount. HGI was calculated by the specified formula. The greater the value of HGI, the more easily the coke was pulverized.

TABLE 5

| Amount of RE1 added (ppm) | Petroleum cokes Yield (wt. %) | Cracked oil Yield (wt. %) | Ti (°C.) | HGI | V (ppm) | Rare earth metal (ppm) |
|---|---|---|---|---|---|---|
| Not added | 37.8 | 41.7 | 483 | 24 | 1296 | 0 |
| 200 | 35.7 | 43.6 | 471 | 48 | 1372 | 560 |

As shown in Table 5, thermal cracking of a heavy petroleum oil with an addition of a rare earth metal compound resulted in the production of petroleum cokes having an excellent pulverizability.

EXAMPLE 4

Petroleum cokes A and B as shown in Table 6 were obtained by thermal cracking of the feed oil No. 3 shown in Table 1 in the same apparatus as in Example 1 under the conditions of 475° C. and 5 kg/cm$^2$·G for 14 hours. Coke A was obtained without the use of a rare earth metal compound; on the other hand, coke B was obtained with the use of the feed oil in an amount of 980 ppm (as element) of rare earth metal compound RE1 as shown in Table 2. The petroleum cokes were pulverized into 200 mesh, washed with an organic solvent, and dried. The yield of the coke B was 24 wt. %, while the yield of coke A which was thermally cracked without the addition of rare earth metal compounds was 30.7 wt. %. Coke B contained 4,000 ppm of rare earth metals (as element). Several samples shown in Table 6 were prepared by blending cokes A and B at varied proportions to measure their burning point (Tb) according to the following method.

Measurement of Burning Point (Tb)

Petroleum coke (20 mg) was placed on a differential thermal analyzer (Thermoflex type PTC-10A: trademark, manufactured by Rigaku Denki Co.) and heated under a nitrogen atmosphere from room temperature to a prescribed temperature at a rate of 20° C. per minute. At temperatures of 600° C., 650° C., 700° C., and 750° C., a portion of the sample was burned in air to measure a period of time required for the sample to burn out. The temperature required by the coke to burn out in 20 minutes was determined based on the results by extrapolation. This temperature was taken as the burning point (Tb).

TABLE 6

| | Blending ratio of cokes (wt. %) | | | |
|---|---|---|---|---|
| Coke A | 100 | 99 | 80 | 50 |
| Coke B | 0 | 1 | 20 | 50 |
| Rare earth metal content (ppm) | 0 | 40 | 800 | 2,000 |
| Burning time (min): | | | | |
| at 650° C. | 26.0 | 25.5 | 25.0 | 24.0 |
| at 700° C. | — | — | — | 21.0 |
| at 750° C. | 22.0 | 21.0 | 20.0 | — |
| Burning point (Tb) (°C.) | 800 | 775 | 750 | 715 |

As shown in Table 6, petroleum cokes obtained by thermal cracking with an addition of rare metal compounds exhibit a greatly decreased burning point.

REFERENCE EXAMPLE

A sample of petroleum coke containing 2,000 ppm of rare earth metal (as element), same as the 50:50 sample in Table 6, was made by the addition of rare earth metal compound RE1 in Table 2 to coke A as shown in Table 6, and its burning point (Tb) was measured. The resulting burning point was 760° C., which is 45° C. higher than the burning point of 715° C. of the 1:1 blend sample in Table 6 in spite of the same rare earth metal content. This demonstrates that the addition of rare earth metal compounds to raw oil for the thermal cracking is more effective than addition after coking.

Obviously, numerous modifications and variations of the present invention are possible in light of the above teachings. It is therefore to be understood that the scope of the invention is defined in appended claims and the invention may be practiced otherwise than as specifically described herein.

What is claimed is:

1. A process for manufacturing petroleum cokes and cracked oil, which comprises:

adding at least one organic compound of a rare earth metal in an amount of 5–3,000 ppm (as element) to heavy petroleum oil selected from the group consisting of residual oil from atmospheric or vacuum distillation of petroleum crude oils, cycle oils from thermal cracking or catalytic cracking processes of petroleum oils, and combinations thereof, and subjecting the heavy petroleum oil to thermal cracking at a temperature of 450°–650° C. and under a pressure of atmospheric to 15 kg/cm$^2$·G.

2. The process according to claim 1, wherein said at least one organic compound of a rare earth metal in an amount of 10–2,000 ppm (as element) is added to the heavy petroleum oil.

3. The process according to claim 1, wherein said at least one organic compound of a rare earth metal is an organic acid salt of a rare earth metal.

4. The process according to claim 1, wherein said rare earth metal is selected from the group consisting of cerium, lanthanum, neodymium, praseodymium, samarium, and combinations thereof.

5. The process according to claim 1, wherein said petroleum cokes contain 20–5,000 ppm (as element) of said organic compound of a rare earth metal.

6. The process according to claim 1, wherein said petroleum cokes contain 50–5,000 ppm (as element) of said organic compound of a rare metal.

7. The process according to claim 1, wherein said organic compound of a rare earth metal is a salt of a fatty acid, a salt of a dicarboxylic acid, a salt of an aromatic carboxylic acid, a naphthenate, a sulfonate, a chelating compound, an alkoxide, or combinations thereof.

8. The process according to claim 1, wherein said organic compound of a rare earth metal contains 30–60% cerium, 20–30% lanthanum, and 10–30% neodymium.

9. The process according to claim 1, wherein said organic compound of a rare earth metal is soluble in said heavy petroleum oil.

10. The process according to claim 9, wherein said organic compound of a rare earth metal is directly added to the heavy petroleum oil or dissolved in an organic hydrocarbon.

11. A process for manufacturing petroleum cokes and cracked oil, which comprises:

adding an effective amount of at least one organic compound of a rare earth metal to heavy petroleum oil selected from the group consisting of residual oil from atmospheric and vacuum distillation of petroleum crude oils, cycle oils from thermal cracking or catalytic cracking processes of petroleum oils, and combinations thereof, for improving the combustibility of petroleum cokes, and subjecting said heavy petroleum oil to thermal cracking at a temperature of 450°–650° C. and under a pressure of atmospheric to 15 kg/cm$^2$·G.

12. The process according to claim 11, wherein at least one organic compound of a rare earth metal in an amount of 5–400 ppm (as element) is added to the heavy petroleum oil.

13. The process according to claim 11, wherein said at least one organic compound of a rare earth metal is an 2-ethylhexanoate of a rare earth metal.

14. A process for manufacturing petroleum cokes and cracked oil, which comprises:

adding at least one organic compound of a rare earth metal in an amount of 5–3,000 ppm (as element) to heavy petroleum oil selected from the group consisting of residual oil from vacuum distillation of petroleum crude oils, cycle oils from thermal cracking or catalytic cracking processes of petroleum oils, and combinations thereof, and subjecting said heavy petroleum oil to thermal cracking at a temperature of 450°–650° C. and under a pressure of atmospheric to 15 kg/cm$^2$·G.

15. A process for manufacturing petroleum cokes and cracked oil, which comprises:

adding at lest one organic compound of a rare earth metal in an amount of 5–3,000 ppm (as element) to heavy petroleum oil containing about 5–25% by weight of asphatene and about 10–30% by weight of residual carbon, and subjecting the heavy petroleum oil to thermal cracking at a temperature of 450°–650° C. and under a pressure of atmospheric to 15 kg/cm$^2$·G.

16. The process according to claim 15, wherein the heavy petroleum oil further contains about 20–2,000 ppm of vanadium.

17. The method of claim 1, 11, 14 or 15, wherein said organic compound of a rare earth metal is a fatty acid soap of a rare earth metal.

18. The process of claim 1, 11, 14 or 15, wherein said organic compound of a rare earth metal is a rare earth metal salt of a saturated or unsaturated fatty acid having 3–18 carbon atoms.

19. The process of claim 1, 11, 14 or 15, wherein said organic compound of a rare earth metal is a rare earth metal salt of an organic acid selected from the group consisting of caprylic acid, pelargonic acid, capric acid, lauric acid and napthenic acid.

* * * * *